US007071803B2

(12) United States Patent
Oki

(10) Patent No.: US 7,071,803 B2
(45) Date of Patent: Jul. 4, 2006

(54) MICRO SURFACE MOUNT COIL UNIT

(75) Inventor: Juichi Oki, Tokyo (JP)

(73) Assignee: Sumida Corporation, Tokyo (JP)

( * ) Notice: Subject to any disclaimer, the term of this patent is extended or adjusted under 35 U.S.C. 154(b) by 66 days.

(21) Appl. No.: 10/889,129

(22) Filed: Jul. 13, 2004

(65) Prior Publication Data

US 2005/0017835 A1 Jan. 27, 2005

(30) Foreign Application Priority Data

Jul. 23, 2003 (JP) ..... 2003-278246

(51) Int. Cl.
*H01F 27/02* (2006.01)

(52) U.S. Cl. ..... 336/83; 336/192

(58) Field of Classification Search ..... 336/83, 336/192

See application file for complete search history.

(56) References Cited

U.S. PATENT DOCUMENTS 5,307,041 A * 4/1994 Kato et al. ..... 336/83
5,751,203 A * 5/1998 Tsutsumi et al. ..... 336/65
6,292,083 B1 * 9/2001 Tajima et al. ..... 336/192

FOREIGN PATENT DOCUMENTS

JP 05036530 A * 2/1993
JP 10-22137 1/1998
JP 11-283840 10/1999

* cited by examiner

*Primary Examiner*—Anh Mai
(74) *Attorney, Agent, or Firm*—Snider & Associates; Ronald R. Snider

(57) ABSTRACT

There is provided a micro surface mount coil unit in which the occurrence of positional shift and poor soldering at the time of soldering of the coil unit is avoided without decreasing the width of a coil winding portion of coil form, and the shock resistance of coil unit is increased. The coil unit 10 has a drum-shaped core 11 in which a coil form part around which a coil wire is wound is arranged between flange parts 13 and 14 and a lead frame 12 bondingly fixed to the lower flange part 14. The lead frame 12 has left and right lead frame parts 12A and 12B bonded to the lower flange part 14, and the outside surface of a bottom surface 18 of each of the lead frame parts 12A and 12B is separated into a first region forming an external connecting terminal 15 and a second region not forming the external connecting terminal 15 by notches 17.

10 Claims, 6 Drawing Sheets

EXAMPLE

MICRO SURFACE MOUNT COIL UNIT

RELATED APPLICATIONS

This application claims the priority of Japanese Patent Application No. 2003-278246 filed on Jul. 23, 2003, which is incorporated herein by reference.

BACKGROUND OF THE INVENTION

1. Field of the Invention

The present invention relates to a micro surface mount coil unit suitable for electronic equipment especially required to be small and thin, such as cellular phones, digital cameras, notebook type personal computers, and mobile computing devices including electronic notebooks.

2. Description of the Prior Art

In recent years, with the widespread use of electronic equipment etc. especially required to be micro, such as cellular phones, a coil unit used in the electronic equipment has been required to be significantly small in size.

As a coil unit capable of being significantly miniaturized, a surface mount coil unit attached to a circuit board, for example, as shown in FIGS. 6A and 6B, is known.

A coil unit 210 shown in FIGS. 6A and 6B has a drum-shaped core 211 in which flange parts 213 (upper flange part) and 214 (lower flange part) are extendedly provided at both ends of a coil form part (not shown in FIGS. 6A and 6B) around which a coil wire is wound and a lead frame 212 which is bonded to the axially outside surface of one flange part 214.

The lead frame 212 is formed by a metal sheet, and consists of left and right lead frame parts 212A and 212B bonded in a pair to the lower flange part 214 of the drum-shaped core 211 as shown in FIG. 6B. Each of the lead frame parts 212A and 212B has a pair of coil wire binding terminals 216 to which the end portion of coil wire is bound, and also has an external connecting terminal 215 soldered to the wiring pattern (electrode land) of a circuit board to which this coil unit 210 is attached.

Generally, the core 211 of the above-described coil unit 210 is formed of a breakable sintered material such as ferrite, so that the shock resistance is raised by bondingly fixing the lead frame 212 to the flange part on the circuit board side so as to cover most of the outside surface of this flange part. In this configuration, however, the width of bottom surface of the lead frame 212 is almost equal to or larger than the width of the lower flange part 214, thus being considerably larger than the width of circuit board pattern. As a result, when the bottom surface of the lead frame 212 is soldered onto the circuit board pattern to which cream solder is applied, the lead frame slips on the solder melted by heating (reflow solder), so that the coil unit turns or shifts laterally with respect to the circuit board pattern, resulting in a fear that the coil unit is attached to a position different from the designed position.

Also, the molten solder moves and spreads on the outside surface of the lead frame, so that the quantity of solder actually contributing to the connection with the pattern decreases, which may result in poor soldering.

Further, there arises a need for increasing the width of the circuit board pattern (land size), which poses a problem in that it is difficult for the coil unit to be mounted with high density according to the decrease in assembled component size.

Thereupon, in the prior art shown in FIGS. 6A and 6B, a part of the bottom surface of each of the left and right lead frame parts 212A and 212B (having almost the same width as that of circuit board pattern) is protruded to the pattern connection side to form the terminal part 215 so that this terminal part 215 is soldered to the circuit board pattern. Thereby, the widths of two elements being soldered are made almost the same, so that the above-described positional shift of coil unit and poor soldering can be avoided, and the packaging density of circuit board can be improved. Moreover, the shock resistance of coil unit can be increased.

A configuration similar to the above-described configuration is also described in, for example, Japanese Unexamined Patent Publication No. 11(1999)-283840.

In such a coil unit, a decrease in direct current resistance (DCR) value of coil wire is important for improvement in direct current superposition properties.

However, as described above, the coil unit that is used for electronic equipment especially that which is required to be small and thin must be short, and the axial length of drum-shaped core is required to be very small, being about 0.5 to 1.0 mm, for example.

Therefore, in such a short and small coil unit, it is necessary that the largest possible space for coil winding portion of the coil form be secured, and thereby the wire diameter of coil can be increased to decrease the DCR value.

Considering such circumstances, in the above-described prior art, the terminal part 215 is protruded to the pattern connection side, and hence the space for the coil winding portion of the coil form becomes short accordingly, so that there is formed a state of being inverse to the improvement in direct current superposition properties (decrease in DCR value).

The amount of protrusion of the terminal part 215 is as small as, for example, about 0.1 mm. However, if the winding width of the coil form is, for example, about 0.3 mm, the coil wire diameter becomes ¾ times as compared with the case where the terminal part 215 is not protruded, so that the DCR value undesirably becomes 16/9 times.

SUMMARY OF THE INVENTION

The present invention has been made in view of the above situation, and accordingly an object thereof is to provide a micro surface mount coil unit capable of avoiding the occurrence of positional shift and poor soldering at the time of soldering of the coil unit without decreasing the width of a coil winding portion of the coil form, capable of improving the packaging density of a circuit board, and capable of increasing the shock resistance of coil unit.

The present invention provides a micro surface mount coil unit comprising:

a coil unit body having a drum-shaped core having a coil form part around which a coil wire is wound and flange parts provided at both ends of the coil form part; and a lead frame having a flange part mounting plate for mounting one of the flange parts of the drum-shaped core on the inside surface thereof and a conductive connecting terminal connected to a conductive part of a circuit board and is held by the one flange part, wherein the flange part mounting plate is formed of a flat plate member; wherein an outside surface of the flange part mounting plate is formed by a first region which is connected to the conductive part and functions as the conductive connecting terminal and a second region which is not connected to the conductive part and does not function as the conductive connecting terminal; and a molten solder spread preventing portion having any one of a notch, through hole, and groove is provided at least at a part of a boundary portion between the two regions.

Herein, the above-described "molten solder spread preventing portion" has only to perform a function of alleviating the spread of solder from the first region to the second region, and does not mean that it performs a function of completely inhibiting the spread.

The one flange part is preferably fixed to the inside surface of the flange part mounting plate so as to be in close contact with the inside surface thereof.

The lead frame can be configured so that the lead frame consists of right and left lead frame parts separated from each other, and each of the right and left lead frame parts is provided with the first region, second region, and molten solder spread preventing portion.

It is preferable that the first region be arranged at a position such as to be held between the second regions, and the molten solder spread preventing portion be provided in a boundary portion with the second region at both sides of the first region.

Also, the lead frame is preferably provided with an erecting part for holding the peripheral wall of the one flange part from the outside.

Further, the micro surface mount coil unit in accordance with the present invention is especially useful when the axial length of the drum-shaped core is set so as to be not shorter than 0.5 mm and not longer than 1.0 mm.

DETAILED DESCRIPTION OF THE PREFERRED EMBODIMENTS

A micro surface mount coil unit in accordance with embodiments of the present invention will now be described with reference to the accompanying drawings.

First Embodiment

Figure 1:
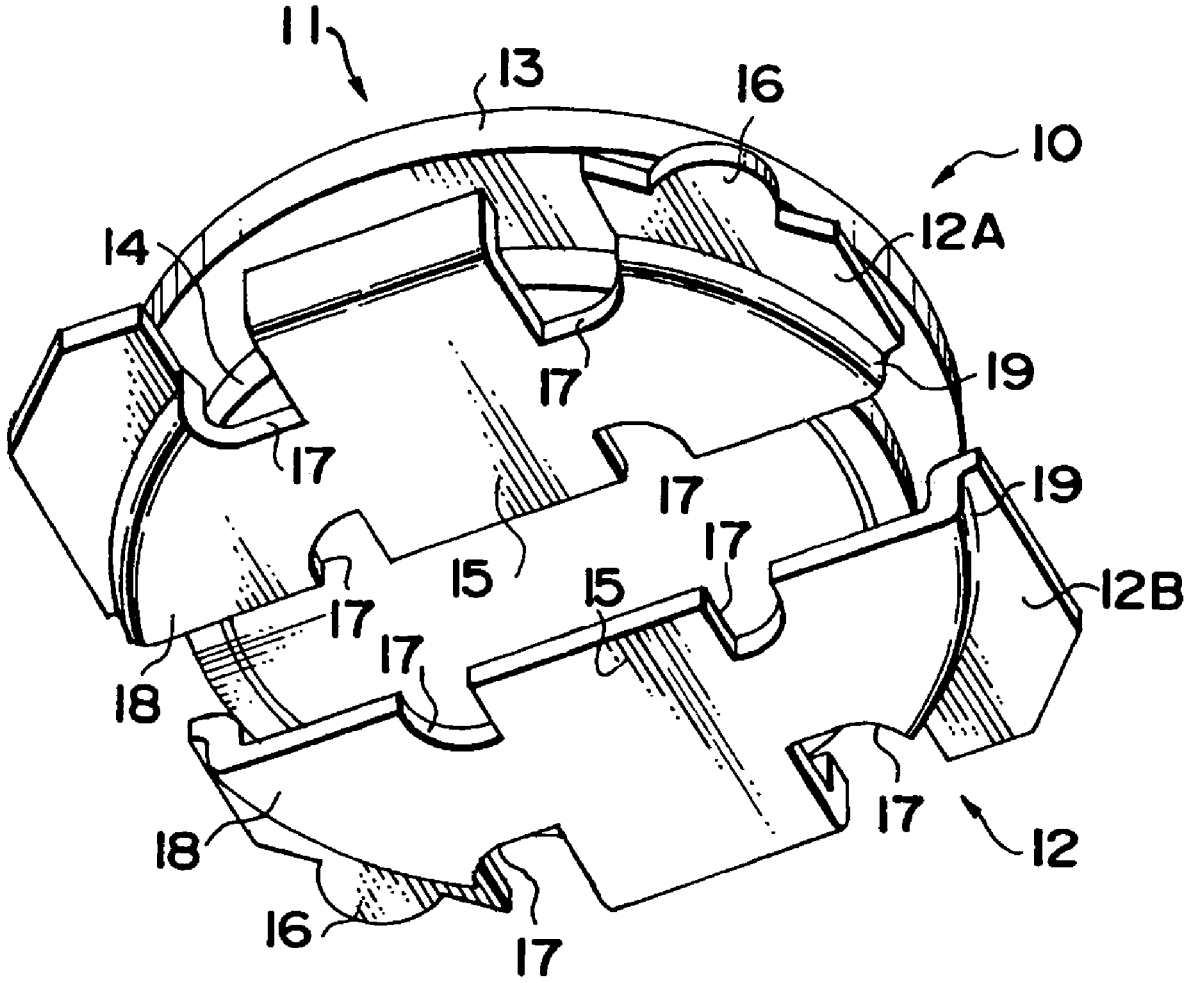
FIG. 1 is a perspective view of a micro surface mount coil unit in accordance with a first embodiment of the present invention, viewed from the bottom surface side.
Figure 2:
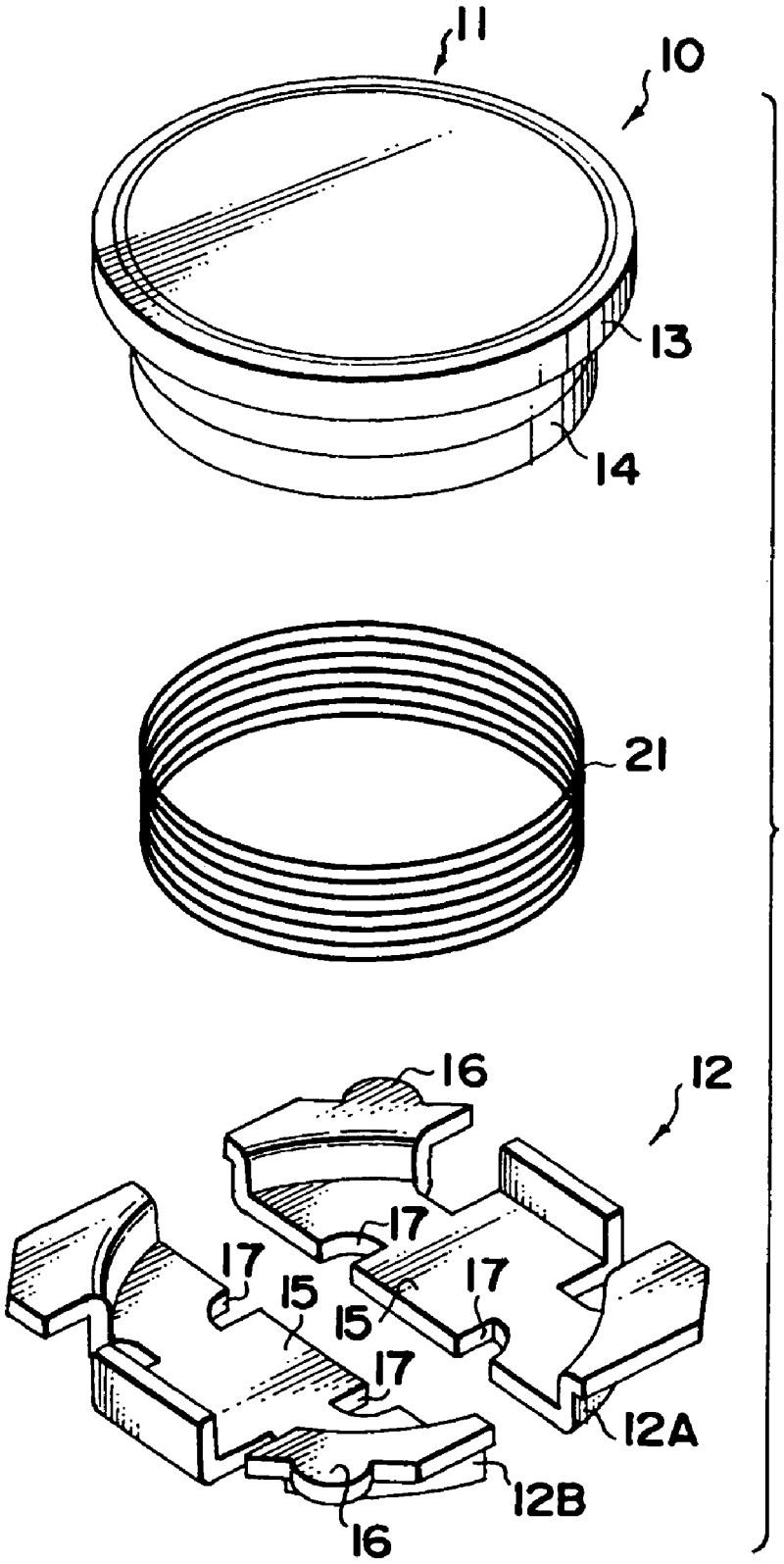
FIG. 2 is an exploded perspective view of a micro surface mount coil unit in accordance with a first embodiment of the present invention.

FIG. 1 is a perspective view of a micro surface mount coil unit in accordance with a first embodiment of the present invention, viewed from the bottom surface side, and FIG. 2 is an exploded perspective view of the micro surface mount coil unit.

This micro surface mount coil unit 10 is surface mounted on a circuit board of electronic equipment especially required to be small and thin, such as cellular phones, digital cameras, notebook type personal computers, and mobile computing devices including electronic notebooks. The coil unit 10 is provided with a drum-shaped core 11 in which a columnar coil form part (not shown in FIGS. 1 and 2; refer to a coil form part 131 in FIG. 5(A)) and a disk-shaped flange parts 13 and 14 extendedly provided at both ends of a coil form part are integrally formed of ferrite.

A coil 21 is wound around the coil form part of the drum-shaped core 11 so as to be held between the upper flange part 13 and the lower flange part 14 (the lower flange part 14 has a smaller diameter than the upper flange part 13).

Also, a lead frame 12 is bondingly fixed to the lower flange part 14.

The lead frame 12 is formed by a metal sheet, and consists of left and right lead frame parts 12A and 12B (one is for input and the other is for output) bonded in a pair to the lower flange part 14 of the drum-shaped core 11 as shown in FIGS. 1 and 2. Each of the lead frame parts 12A and 12B has a bottom surface 18 that is in contact with the axially outside surface of the lower flange part 14, a peripheral erecting part 19 for contactingly holding the peripheral wall of the lower flange part 14 so as to cover the peripheral wall thereof, a pair of coil wire binding terminals 16 to which the end portion of coil wire is bound (FIG. 1 shows a final state in which an outer member has been welded to the binding terminal, and the binding terminal before the coil wire is bound has the same shape as that of a binding terminal 116 shown in FIGS. 3A and 3B.), and an external connecting terminal 15 soldered to the wiring pattern (electrode land) of a circuit board to which this coil unit 10 is attached.

Thus, most of the outside surface of the lower flange part 14, which is liable to come into contact with the circuit board etc., is covered with the lead frame 12, and moreover the lead frame 12 is fixed to the outside surface of the lower flange part 14 so as to be in close contact with the outside surface thereof, so that the shock resistance of the coil unit 10 provided with the breakable drum-shaped core 11 can be increased.

As the metal for forming the lead frame 12, a metal having excellent conductivity and machinability is preferably used; for example, copper or phosphor bronze is preferable. In particular, when emphasis is laid on light weight, aluminum can be used. However, the metal is not limited to the above-described kinds of metals.

In the micro surface mount coil unit of this embodiment, the outside surface of the bottom surface 18 of each of the lead frame parts 12A and 12B is separated by notches 17 into a first region forming the external connecting terminal 15 and a second region not forming the external connecting terminal 15. Specifically, on both sides of the first region forming the external connecting terminal 15, there are provided the notches 17 which are formed being notched from the sides corresponding to the central portion and peripheral portion of the lower flange part 14 to serve as molten solder spread preventing portions, so that even when the coil unit 10 is soldered onto the circuit board pattern, the velocity at which the molten solder on the surface of the first region moves and spreads to the second region can be decreased significantly.

If the velocity at which the molten solder moves and spreads can be decreased significantly, the quantity of solder moving and spreading to the second region can be ignored substantially because the molten solder solidifies during staying in the first region.

As described above, in the prior art, when the bottom surface of lead frame is soldered onto the circuit board pattern to which cream solder is applied, the lead frame slips on the cream solder melted by heating (generally, cream solder is also applied to the bottom surface of lead frame), so that the coil unit turns or shifts laterally with respect to the circuit board pattern, resulting in a fear that the coil unit is attached to a position different from the designed position. In this embodiment, however, there is no such a fear.

Also, in the prior art, the molten cream solder moves and spreads on the outside surface of lead frame, so that the quantity of solder actually contributing to the connection with the pattern decreases, which results in a fear of poor soldering. In this embodiment, however, there is no such a fear.

In this embodiment, the first region can be made to have a desired small size, and the width of corresponding circuit board pattern (land size) can be made almost the same as the size of the first region. Therefore, the component packaging density of the circuit board can be increased according to the decrease in component size.

The especially important features of this embodiment are that since the function of preventing the spread of molten solder is provided by the notches 17 that separate the first region forming the external connecting terminal 15 from the second region not forming the external connecting terminal 15, there is no need for providing the function of preventing the spread of molten solder by protruding a part of the first region to the pattern connection side from the level of the second region, so that a dead space in the unit height direction, which is produced by the protrusion of the external connecting terminal portion, is not produced. The details of the features of the invention will be described later.

In this embodiment, in the bottom surface 18 of each of the lead frame parts 12A and 12B, the notches 17 serving as molten solder spread preventing portions are formed being notched from the sides corresponding to the central portion and peripheral portion of the lower flange part 14, and the number of notches 17 is four for each of the lead frame parts 12A and 12B. However, the notches 17 may be formed being notched from the side corresponding to either one of the central portion and peripheral portion of the lower flange part 14. In this case, the number of notches 17 is two for each of the lead frame parts 12A and 12B.

Also, the shape of the notch 17 is not limited to the one shown in FIGS. 1 and 2. For example, the shape may be such that the notch is cut into the external connecting terminal 15 side toward the tip end of the notch 17 to increase the separation ratio between the first region and the second region provided by the notches 17 (the same is true in the second embodiment described later).

In the above-described first embodiment, the drum-shaped core 11 is constructed so that the upper flange part 13 has a larger diameter than the lower flange part 14. However, the diameter of the upper flange part 13 may be smaller than or equal to that of the lower flange part 14.

Second Embodiment

Figure 3A:
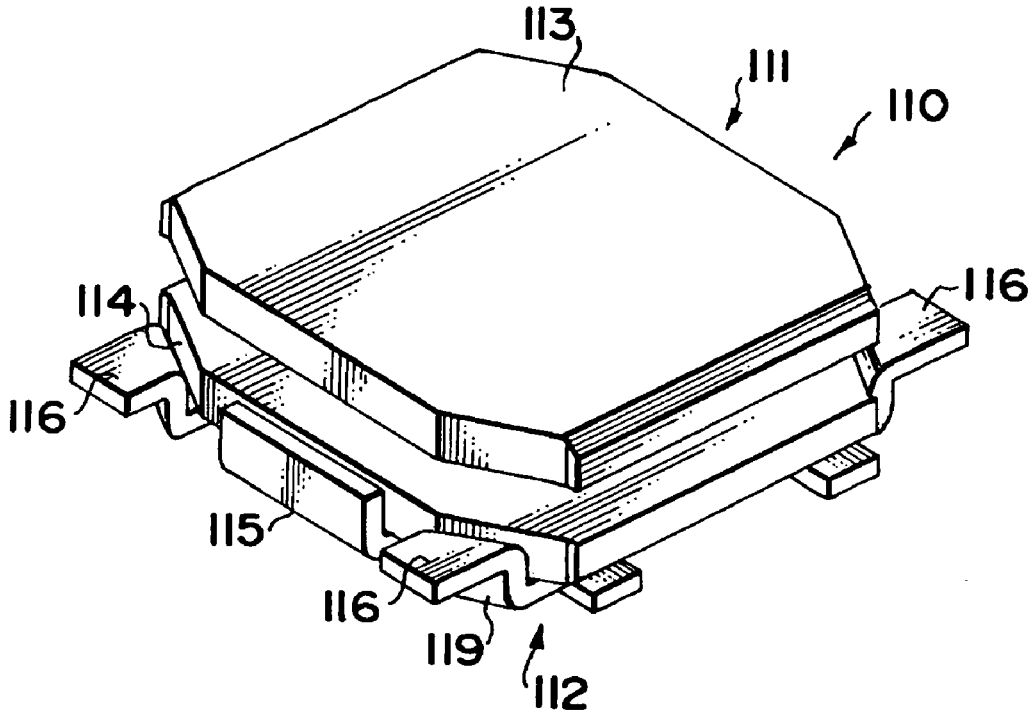
FIGS. 3A and 3B are perspective views of a micro surface mount coil unit in accordance with a second embodiment of the present invention, FIG. 3A being viewed from the top surface side, and FIG. 3B being viewed from the bottom surface side.
Figure 3B:
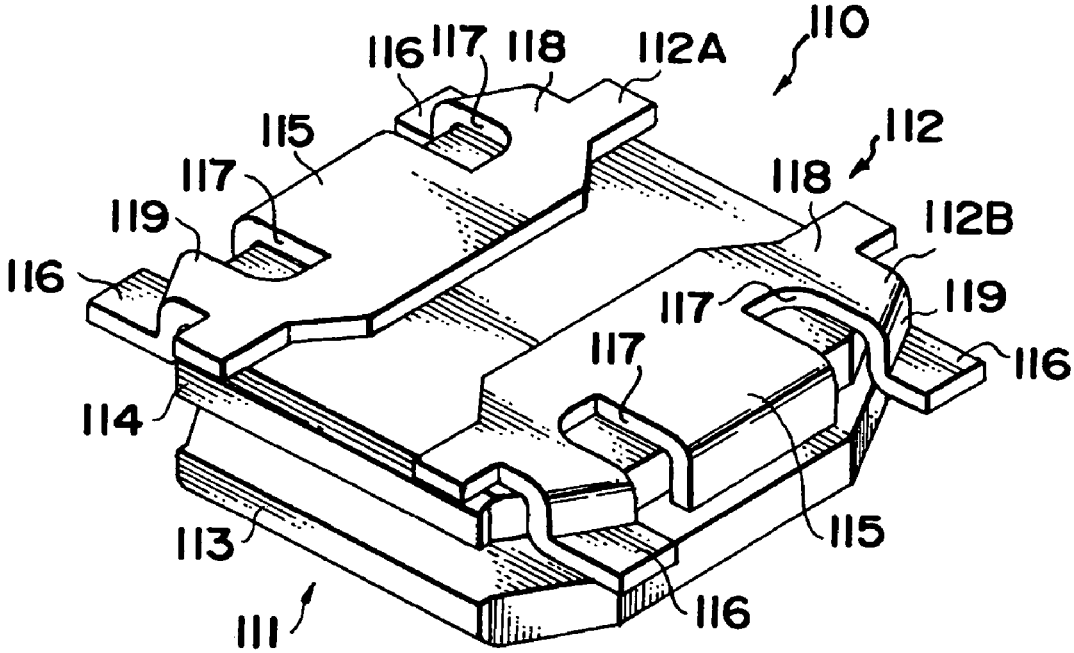
Figure 4:
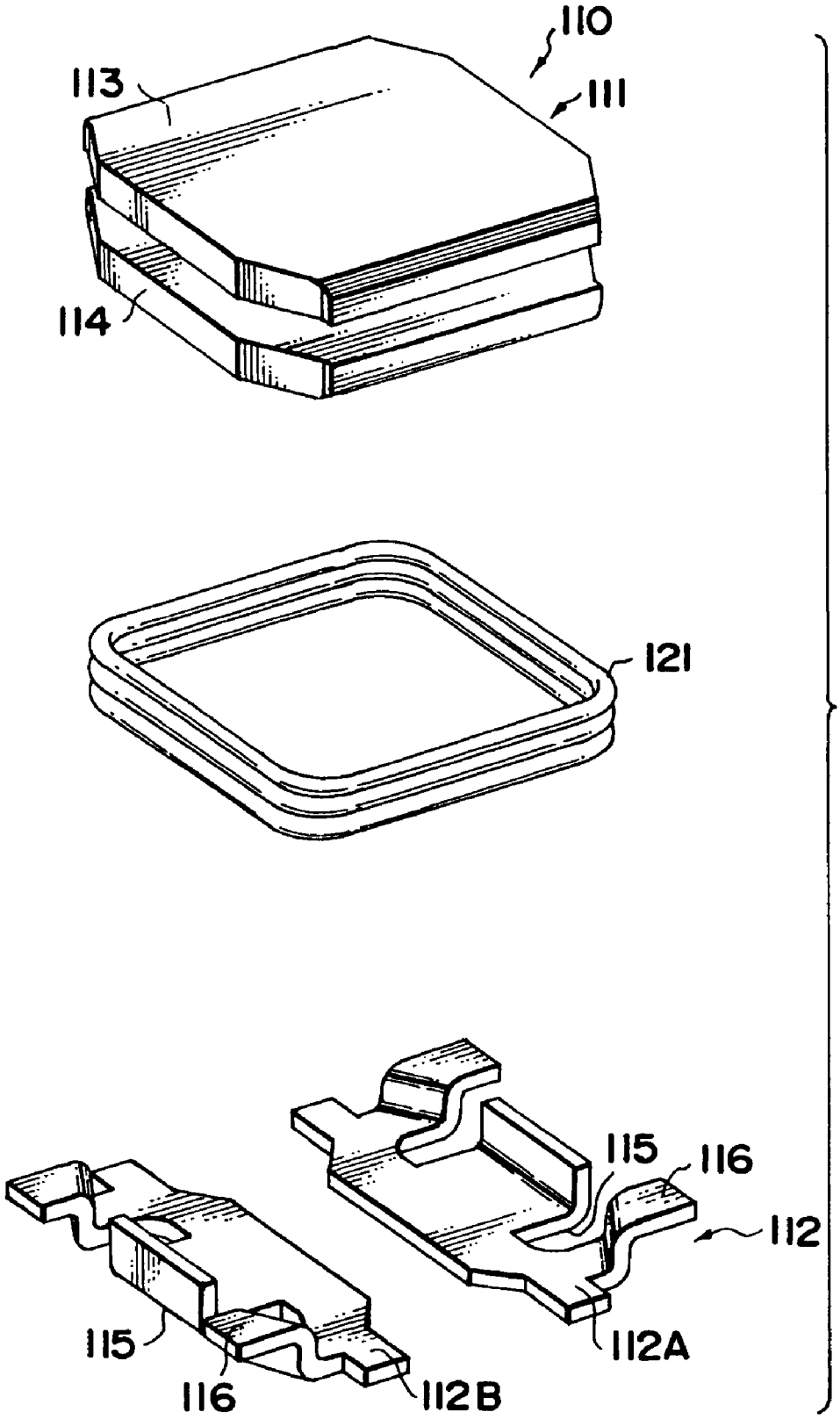
FIG. 4 is an exploded perspective view of a micro surface mount coil unit in accordance with a second embodiment of the present invention.

FIGS. 3A and 3B are perspective views of a micro surface mount coil unit in accordance with a second embodiment, FIG. 3A being viewed from the top surface side, and FIG. 3B being viewed from the bottom surface side; and FIG. 4 is an exploded perspective view of the micro surface mount coil unit.

This micro surface mount coil unit 110 has almost the same construction as that of the micro surface mount coil unit 10 of the first embodiment except that upper and lower flange parts 113 and 114 of a drum-shaped core 111 has a substantially rectangular shape the four corners of which are chamfered. Therefore, in FIGS. 3A, 3B and 4, reference numerals that are obtained by adding 100 to the reference numerals applied in FIGS. 1 and 2 are applied to elements corresponding to the elements of the micro surface mount coil unit 10 of the first embodiment shown in FIGS. 1 and 2, and only the schematic construction is described, the explanation of the details being omitted.

This micro surface mount coil unit 110 is provided with a drum-shaped core 111 in which a columnar coil form part (not shown in FIGS. 3A, 3B and 4; refer to the coil form part 131 in FIG. 5A) around which a coil wire 121 is wound and substantially rectangular plate-shaped flange parts 113 and 114 extendedly provided at both ends of a coil form part are integrally formed of ferrite. A lead frame 112 is bondingly fixed to the lower flange part 114. The lead frame 112 consists of left and right lead frame parts 112A and 112B (one is for input and the other is for output) bonded in a pair to the lower flange part 114 of the drum-shaped core 111. Each of the lead frame parts 112A and 112B has a bottom surface 118 that is in contact with the axially outside surface of the lower flange part 114, a peripheral erecting part 119 for contactingly holding the peripheral wall of the lower flange part 114 so as to cover the peripheral wall thereof, coil wire binding terminals 116 to which the end portion of coil wire is bound, and an external connecting terminal 115 soldered to the wiring pattern of a circuit board to which this coil unit 110 is attached.

The bottom surface 118 of each of the lead frame parts 112A and 112B is separated by notches 117 into a first region forming the external connecting terminal 115 and a second region not forming the external connecting terminal 115. Thereby, molten solder on the surface of the first region is substantially prevented from moving and spreading to the second region when the external connecting terminal 115 is soldered to the wiring pattern of circuit board.

In the micro surface mount coil unit 110 of this embodiment, in the bottom surface 118 of each of the lead frame parts 112A and 112B, the notches 117 are formed being notched from only the side corresponding to the peripheral portion of the lower flange part 114, and the number of notches 117 is two for each of the lead frame parts 112A and 112B.

Also, in the micro surface mount coil unit 110 of this embodiment, the upper and lower flange parts 113 and 114 have the same size.

The micro surface mount coil unit 110 of the second embodiment can also achieve the same functions and effects as those of the micro surface mount coil unit 10 of the first embodiment.

Modifications

Although the notches 17, 117 are used as molten solder spread preventing portions in the above-described embodiments, a through hole may be provided at least at a part of the boundary portion between the first region and the second region to form the molten solder spread preventing portion. The shape of the through hole is not subject to any special restriction. For example, the through hole has an elongated hole shape extending long along the boundary portion. The number of through holes is not limited to one for each side of the first region of each of the lead frame parts 12A, 12B, 112A, 112B, and more than one through holes may be arranged in rows along the boundary portion.

Also, as the molten solder spread preventing portion, a groove may be used which is formed along the boundary portion in the bottom surface 18, 118 of each of the lead frame parts 12A, 12B, 112A, 112B.

The groove may be formed over the entire length of the boundary portion or may be formed at a part thereof. Also, the width and depth of the groove may be set so that a volume is provided such that the molten solder that moves and spreads from the first region is trapped by this groove and solidifies during this time.

When the groove is used as the molten solder spread preventing portion, it is preferable that the cream solder applied to the lead frame be removed in advance from this groove.

Also, the shape of the micro surface mount coil unit in accordance with the present invention is not limited to the shapes described in the above-described embodiments. The shapes of the coil form part and flange parts of the drum-shaped core and the shape of the lead frame can be changed variously. For example, the shape of the coil form part is not limited to the columnar shape, and may be a prismatic shape.

The magnetic material forming the drum-shaped core is preferably ferrite. However, permalloy, Sendust, iron carbonyl, and other magnetic materials can be used.

Features of the Embodiments

As described above, in the above-described embodiments, the first region and the second region are formed on one plane, so that a dead space in the unit height direction, which is produced by the protrusion of the external connecting terminal portion in the prior art, is not produced.

Figure 5A:
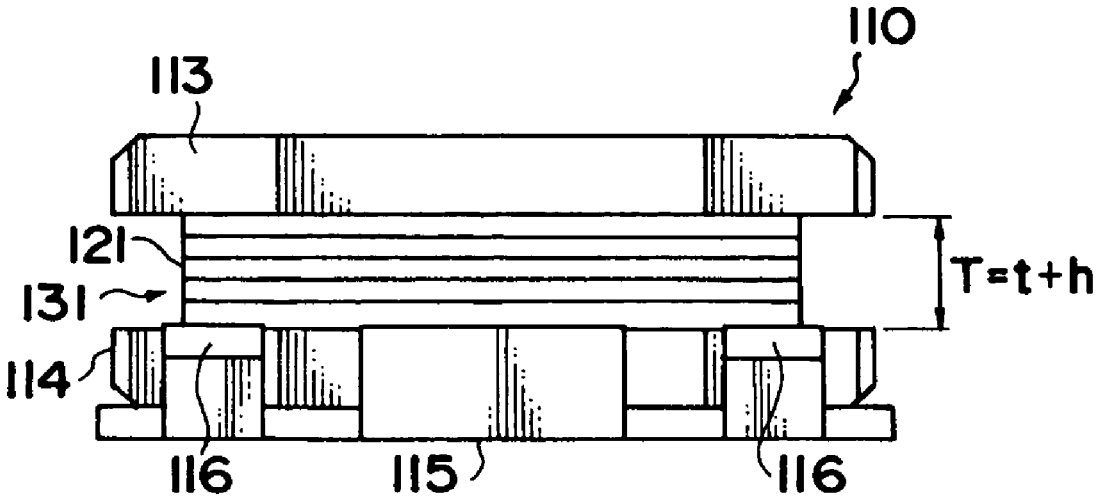
FIGS. 5A and 5B are schematic views for comparing the coil form length of the second embodiment with that of the prior art, FIG. 5A showing the second embodiment, and FIG. 5B showing the prior art.
Figure 5B:
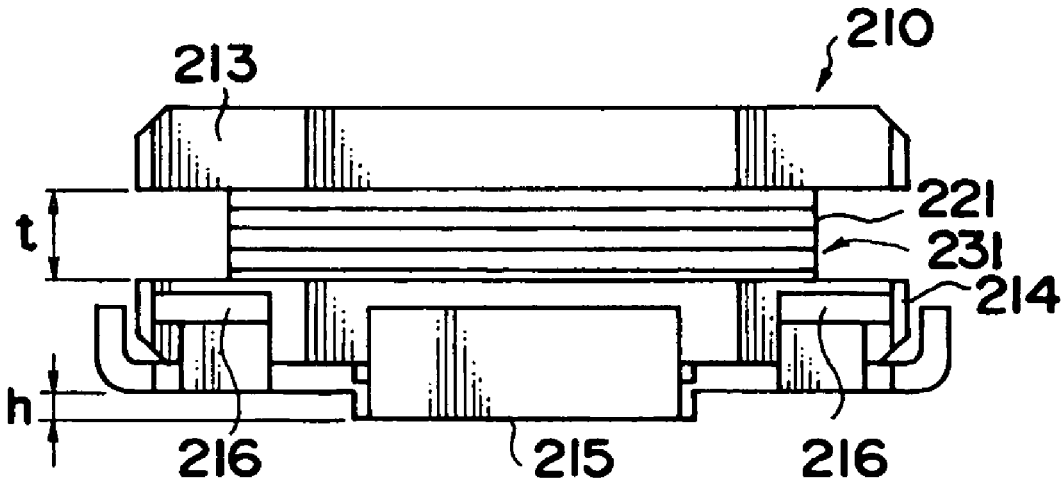
Fig.5B PRIOR ART
Figure 6A:
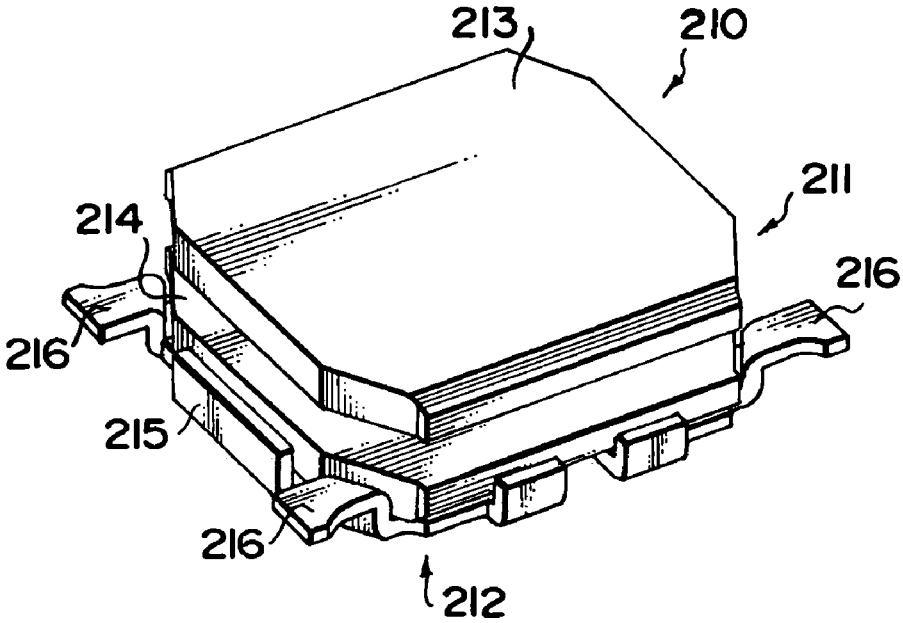
Fig.6A PRIOR ART
FIGS. 6A and 6B are perspective views of a micro surface mount coil unit in accordance with the prior art, FIG. 6A being viewed from the top surface side, and FIG. 6B being viewed from the bottom surface side.
Figure 6B:
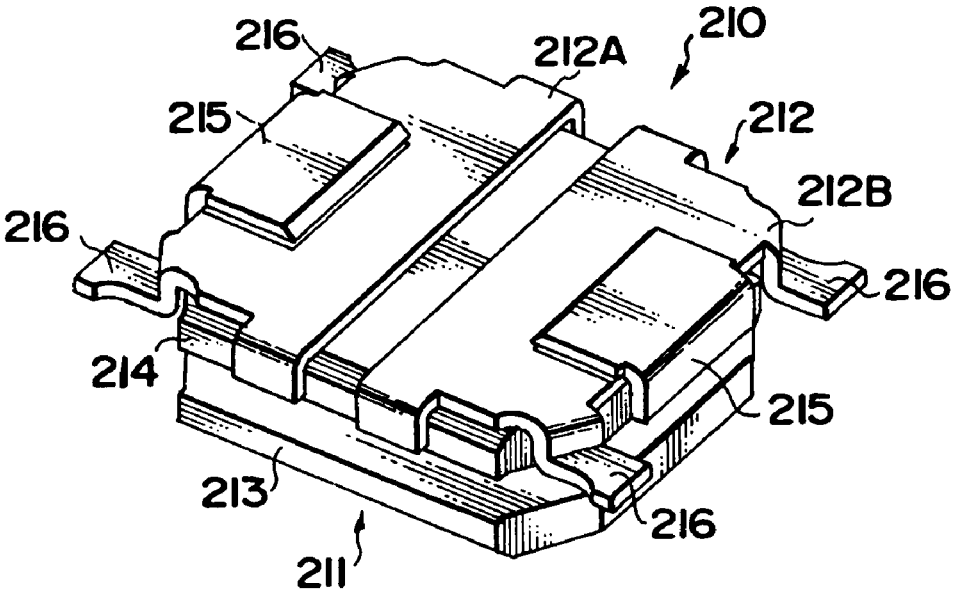
Fig.6B PRIOR ART

The effect achieved by this construction is explained by comparing the coil form length (T shown in FIG. 5A, t shown in FIG. 5B) of the micro surface mount coil unit 110 of the second embodiment (the micro surface mount coil unit in accordance with the present invention is represented by the micro surface mount coil unit 110 of the second embodiment because the micro surface mount coil unit 10 of the first embodiment achieves the same operations and effects) with that of the micro surface mount coil unit 210 of the prior art with reference to FIGS. 5A and 5B.

As shown in FIG. 5B, in the micro surface mount coil unit 210 of the prior art, the lower end portion of the coil unit 210 is not flat, and the external connecting terminal 215 protrudes downward through distance h from other portions (bottom surface that is flush with the root of the binding terminal 214). Whereas, as shown in FIG. 5A, in the micro surface mount coil unit 110 of the second embodiment, the external connecting terminal 115 is arranged on the same plane as other portions, so that the lower end portion of the coil unit 110 is flat.

In the coil unit required to be short, generally, the distance from the contact surface with a circuit board to the top surface of the upper flange part is specified so as to be very short, being 0.8 mm, for example. In such an example, if vertical thicknesses of both flange parts of 0.2 mm each are necessary, the remainder is 0.4 mm.

However, in the coil unit 210 of the prior art shown in FIG. 5B, the external connecting terminal 215 protrudes downward through distance h from other portions. Therefore, if the distance h is, for example, 0.1 mm, the vertical length of the coil form part 231 around which a coil wire 221 is wound, is held between the flange parts 213 and 214 is 0.3 mm at the most.

On the other hand, in the coil unit 110 of this embodiment shown in FIG. 5A, the external connecting terminal 115 does not protrude, and hence the distance h is zero. Therefore, the vertical length of the coil form part 131 around which a coil wire is wound, is held between the flange parts 113 and 114 can be made 0.4 mm.

That is to say, in the coil unit 110 of this embodiment, the length of the coil form part 131 can be made ⅔ times as compared with the length of the coil form part 231 of the prior art. In the case of the same number of turns of winding, the diameter of coil wire can be made ⅔ times, so that the direct current resistance (DCR) value can be decreased by 43% or more, which can significantly improve the direct current superposition properties.

Features of the Invention

According to the micro surface mount coil unit in accordance with the present invention, which is configured as described above, a part of the outside surface of the mounting plate for mounting one flange part of the drum-shaped core is made the first region functioning as the conductive connecting terminal, and is separated from the second region that does not function as the conductive connecting terminal by the molten solder spread preventing portion. Therefore, the molten solder in the first region is prevented from moving and spreading to the second region, so that the occurrence of positional shift and poor soldering at the time of soldering of the coil unit can be avoided.

Also, since a part of the outside surface of the mounting plate is made the first region functioning as the conductive connecting terminal, the size of the first region can be made small, and hence the width of circuit board pattern (land size) can be decreased to almost the same size as that of the first region. Therefore, in the circuit board, the packaging density can be increased according to the decrease in assembled component size.

Further, the molten solder spread preventing portion consists of any one of the notch, through hole, and groove formed at least at a part of the boundary portion between the first and second regions, and there is no need for providing a difference in height between the two regions to prevent the spread of molten solder, so that unlike the before-mentioned prior art, the width of coil winding portion of coil form does not decrease with the protrusion of the conductive connecting terminal (corresponding to the first region). Therefore, even in a coil unit required to be small and short, the diameter of coil wire need not be decreased, and the direct current superposition properties can be improved because the rise in direct current resistance value is restrained.

In a case where a direct current resistance value equivalent to that of the prior art has to be secured, the shortening of coil unit can further be promoted.

What is claimed is:

1. A micro surface mount coil unit comprising:

a coil unit body having a drum-shaped core having a coil form part around which a coil wire is wound and flange parts provided at both ends of said coil form part; and a lead frame which has a flange part mounting plate for mounting one of said flange parts of said drum-shaped core on the inside surface thereof and a conductive connecting terminal connected to a conductive part of a circuit board and is held by said one flange part, wherein said flange part mounting plate is formed of a flat plate member; wherein an outside surface of said flange part mounting plate is formed by a first region which is connected to said conductive part and functions as said conductive connecting terminal and a second region which is not connected to said conductive part and does not function as said conductive connecting terminal; and a molten solder spread preventing portion having any one of a notch, through hole, and groove is provided at least at a part of a boundary portion between said two regions.

2. The micro surface mount coil unit according to claim 1, wherein said one flange part is fixed to the inside surface of said flange part mounting plate so as to be in close contact with said inside surface thereof.

3. The micro surface mount coil unit according to claim 1, wherein said lead frame consists of right and left lead frame parts separated from each other, and each of said right and left lead frame parts is provided with said first region, said second region, and said molten solder spread preventing portion.

4. The micro surface mount coil unit according to claim 1, wherein said first region is arranged at a position such as to be held between said second regions, and said molten solder spread preventing portion is provided in a boundary portion with said second region at both sides of said first region.

5. The micro surface mount coil unit according to claim 1, wherein said lead frame is provided with an erecting part for holding the peripheral wall of said one flange part from the outside.

6. The micro surface mount coil unit according to claim 1, wherein said lead frame is formed of any one material of copper, phosphor bronze, and aluminum.

7. The micro surface mount coil unit according to claim 1, wherein the axial length of said drum-shaped core is set so as to be not shorter than 0.5 mm and not longer than 1.0 mm.

8. The micro surface mount coil unit according to claim 1, wherein the magnetic material which forms said drum-shaped core is any one of ferrite, permalloy, Sendust, and iron carbonyl.

9. The micro surface mount coil unit according to claim 1, wherein said coil form part has a columnar or prismatic shape.

10. The micro surface mount coil unit according to claim 1, wherein said coil unit is surface mounted on a circuit board mounted in any one of a cellular phone, digital camera, notebook type personal computer, and mobile computing device.

* * * * *